US010074267B2

(12) United States Patent
Kusakawa

(10) Patent No.: US 10,074,267 B2
(45) Date of Patent: Sep. 11, 2018

(54) APPARATUS FOR ELECTRIC POWER TOOL

(71) Applicant: MAKITA CORPORATION, Anjo-shi, Aichi (JP)

(72) Inventor: Takuya Kusakawa, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 0 days.

(21) Appl. No.: 15/312,857

(22) PCT Filed: May 26, 2015

(86) PCT No.: PCT/JP2015/065084
§ 371 (c)(1),
(2) Date: Nov. 21, 2016

(87) PCT Pub. No.: WO2015/182602
PCT Pub. Date: Dec. 3, 2015

(65) Prior Publication Data

US 2017/0162035 A1 Jun. 8, 2017

(30) Foreign Application Priority Data

May 26, 2014 (JP) ..... 2014-108351

(51) Int. Cl.
*G08C 17/02* (2006.01)
*B25F 5/00* (2006.01)

(52) U.S. Cl.
CPC ..... *G08C 17/02* (2013.01); *B25F 5/00* (2013.01)

(58) Field of Classification Search
CPC ..... G08C 17/02; B25F 5/00
USPC ..... 340/12.5
See application file for complete search history.

(56) References Cited

U.S. PATENT DOCUMENTS 5,903,462 A * 5/1999 Wagner ..... G05D 17/02 318/490
8,169,298 B2 * 5/2012 Wiesner ..... B25F 5/00 340/10.33
2011/0185864 A1 8/2011 Ide
2013/0233584 A1 * 9/2013 Mashiko ..... B25B 21/00 173/181
2014/0025834 A1 1/2014 Mergener
(Continued)

FOREIGN PATENT DOCUMENTS

CN 102139477 A 8/2011
CN 103302642 A 9/2013
(Continued)

OTHER PUBLICATIONS

Jul. 7, 2015 Written Opinion issued in International Patent Application No. PCT/JP2015/065084.
Jul. 7, 2015 International Search Report issued in International Patent Application No. PCT/JP2015/065084.
(Continued)

*Primary Examiner* — Edwin Holloway, III
(74) *Attorney, Agent, or Firm* — Oliff PLC

(57) ABSTRACT

An apparatus for an electric power tool in one aspect of the present invention comprises a controller, a storage device, and a communication device. The controller reads a settable item and a settable range from the storage device in accordance with a request from an external device received by the communication device, and transmits the settable item and the settable range to the external device through the communication device.

7 Claims, 14 Drawing Sheets

(56) References Cited

U.S. PATENT DOCUMENTS

| | | | | |
|---|---|---|---|---|
| 2014/0107853 | A1 | 4/2014 | Ashinghurst et al. | |
| 2014/0184397 | A1* | 7/2014 | Volpert | B25F 5/00 340/12.51 |
| 2015/0135306 | A1* | 5/2015 | Winkler | B25F 5/00 726/17 |

FOREIGN PATENT DOCUMENTS

| | | | |
|---|---|---|---|
| DE | 10 2012 221 997 | A1 | 11/2013 |
| EP | 2 680 093 | A2 | 1/2014 |
| JP | 2011-173233 | A | 9/2011 |
| JP | 2013-000874 | A | 1/2013 |
| JP | 2013-184266 | A | 9/2013 |
| JP | 2013-255962 | A | 12/2013 |
| JP | 2013-255965 | A | 12/2013 |
| JP | 2014-018868 | A | 2/2014 |
| JP | 2014-021538 | A | 2/2014 |
| WO | 2013/187411 | A1 | 12/2013 |

OTHER PUBLICATIONS

Jan. 18, 2018 Extended European Search Report issued in European Patent Application No. 15798927.8.

Nov. 14, 2017 Office Action issued in Japanese Patent Application No. 2014-108351.

May 8, 2018 Office Action issued in Japanese Patent Application No. 2014-108351.

May 31, 2018 Office Action issued in Chinese Patent Application No. 201580027819.

* cited by examiner

WHEN MAKING A READ REQUEST

- TRANSMISSION DATA (EXTERNAL TERMINAL → COMMUNICATION CIRCUIT → CONTROL CIRCUIT)

| | | | |
|---|---|---|---|
| Address L | Address H | Data Length | Check SUM |

- RETURN DATA (CONTROL CIRCUIT → COMMUNICATION CIRCUIT → EXTERNAL TERMINAL)

| | | | | | | | | |
|---|---|---|---|---|---|---|---|---|
| Ack/Nack | | | | | | | | |
| Data0 | Data1 | Data2 | Data3 | Data4 | Data5 | Data6 | Data7 | |
| Data8 | Data9 | Data10 | Data11 | Data12 | Data13 | Data14 | Data15 | Check SUM |

WHEN MAKING A WRITE REQUEST

- TRANSMISSION DATA (EXTERNAL TERMINAL → COMMUNICATION CIRCUIT → CONTROL CIRCUIT)

| | | | | | | | | |
|---|---|---|---|---|---|---|---|---|
| Address L | Address H | Data Length | | | | | | |
| Data0 | Data1 | Data2 | Data3 | Data4 | Data5 | Data6 | Data7 | |
| Data8 | Data9 | Data10 | Data11 | Data12 | Data13 | Data14 | Data15 | Check SUM |

- RETURN DATA (CONTROL CIRCUIT → COMMUNICATION CIRCUIT → EXTERNAL TERMINAL)

| | |
|---|---|
| Ack/Nack | Check SUM |

FIG. 4

(1) COMMAND TRANSMISSION (EXTERNAL TERMINAL → COMMUNICATION CIRCUIT → CONTROL CIRCUIT)

| | | | | |
|---|---|---|---|---|
| Address L | Address H | Data Length | | |
| NUMBER OF COMMANDS (6) | C1 : TOOL SPECIFIC INFORMATION | C2 : INFORMATION OF SET UPPER LIMIT VALUE | C3 : INFORMATION OF SET LOWER LIMIT VALUE | |
| C4 : SETTABLE STEP INFORMATION | C5 : CURRENT TOOL SETTING INFORMATION | C6 : NEW TOOL SETTING INFORMATION | AUTHENTICATION KEY | XX H |

| | | | | |
|---|---|---|---|---|
| b15-b12 : 1111 | | | | b11-b8 : AUTHENTICATION KEY |
| b7 : F_T1 | b6 : F_T2 | b5 : F_write | b4 : 0 | b3-b0 : 1111 |

(2) TRANSMISSION OF EXECUTION COMMAND OF COMMAND C1 (READ TOOL SPECIFIC INFORMATION)

| | | | |
|---|---|---|---|
| Address L | Address H | 16byte | XX H |

(3) TRANSMISSION OF EXECUTION COMMAND OF COMMAND C2 (READ INFORMATION OF SET UPPER LIMIT VALUE)

| | | | |
|---|---|---|---|
| Address L | Address H | 16byte | XX H |

(4) TRANSMISSION OF EXECUTION COMMAND OF COMMAND C3 (READ INFORMATION OF SET LOWER LIMIT VALUE)

| | | | |
|---|---|---|---|
| Address L | Address H | 16byte | XX H |

(5) TRANSMISSION OF EXECUTION COMMAND OF COMMAND C4 (READ SETTABLE STEP INFORMATION)

| | | | |
|---|---|---|---|
| Address L | Address H | 16byte | XX H |

(6) TRANSMISSION OF EXECUTION COMMAND OF COMMAND C5 (READ CURRENT TOOL SETTING INFORMATION)

| | | | |
|---|---|---|---|
| Address L | Address H | 16byte | XX H |

(7)TRANSMISSION OF EXECUTION COMMAND OF COMMAND C6 (READ NEW TOOL SETTING INFORMATION)

| | | | | |
|---|---|---|---|---|
| Address L | Address H | 16byte | | |
| NEW First Speed SETTING VALUE | NEW First Turns SETTING VALUE | NEW Rundown Speed SETTING VALUE | NEW Rundown Turns SETTING VALUE | |
| NEW Final Speed SETTING VALUE | NEW Final Turns SETTING VALUE | CURRENT DATE AND TIME INFORMATION | | XX H |

FIG. 5

FIG. 6

(1) COMMAND RECEPT RESPONSE (CONTROL CIRCUIT → COMMUNICATION CIRCUIT → EXTERNAL TERMINAL)

| | |
|---|---|
| Ack/Nack | XX H |

(2) TRANSMISSION OF EXECUTION RESULT OF COMMAND C1 (TOOL SPECIFIC INFORMATION)

| | | | | | | | | |
|---|---|---|---|---|---|---|---|---|
| Ack/Nack | PRODUCT NAME | TYPE OF MOTOR | | RATED VOLTAGE | | CONTROL SPECIFICATION (CONDUCTION ANGLE / CONSTANT ROTATION) | | |
| | SERIAL NUMBER | FF H | FF H | FF H | FF H | FF H | FF H | XX H |

(3) TRANSMISSION OF EXECUTION RESULT OF COMMAND C2 (INFORMATION OF SET UPPER LIMIT VALUE)

| | | | | | | | |
|---|---|---|---|---|---|---|---|
| Ack/Nack | First Speed UPPER LIMIT VALUE | First Turns UPPER LIMIT VALUE | Rundown Speed UPPER LIMIT VALUE | | Rundown Turns UPPER LIMIT VALUE | | |
| | Final Speed UPPER LIMIT VALUE | Final Turns UPPER LIMIT VALUE | FF H | FF H | FF H | FF H | XX H |

(4) TRANSMISSION OF EXECUTION RESULT OF COMMAND C3 (INFORMATION OF SET LOWER LIMIT VALUE)

| | | | | | | | |
|---|---|---|---|---|---|---|---|
| Ack/Nack | First Speed LOWER LIMIT VALUE | First Turns LOWER LIMIT VALUE | Rundown Speed LOWER LIMIT VALUE | | Rundown Turns LOWER LIMIT VALUE | | |
| | Final Speed LOWER LIMIT VALUE | Final Turns LOWER LIMIT VALUE | FF H | FF H | FF H | FF H | XX H |

(5) TRANSMISSION OF EXECUTION RESULT OF COMMAND C4 (SETTABLE STEP INFORMATION)

| | | | | | | | |
|---|---|---|---|---|---|---|---|
| Ack/Nack | First Speed Step | First Turns Step | Rundown Speed Step | | Rundown Turns Step | | |
| | Final Speed Step | Final Turns Step | FF H | FF H | FF H | FF H | XX H |

(6) TRANSMISSION OF EXECUTION RESULT OF COMMAND C5 (CURRENT TOOL SETTING INFORMATION)

| | | | | | | | |
|---|---|---|---|---|---|---|---|
| Ack/Nack | CURRENT First Speed SET VALUE | CURRENT First Turns SET VALUE | CURRENT Rundown Speed SET VALUE | | CURRENT Rundown Turns SET VALUE | | |
| | CURRENT Final Speed SET VALUE | CURRENT Final Turns SET VALUE | FF H | FF H | FF H | FF H | XX H |

(7) TRANSMISSION OF EXECUTION RESULT OF COMMAND C6 (RESULT OF WRITING OF NEW TOOL SETTING INFORMATION)

| | |
|---|---|
| Ack/Nack | XX H |

APPARATUS FOR ELECTRIC POWER TOOL

CROSS-REFERENCE TO RELATED APPLICATIONS

This international application claims the benefit of Japanese Patent Application No. 2014-108351 filed on May 26, 2014 with the Japan Patent Office, and the entire disclosure of Japanese Patent Application No. 2014-108351 is incorporated herein by reference.

TECHNICAL FIELD

The present invention relates to an apparatus for an electric power tool that is capable of changing settings of operating conditions.

BACKGROUND ART

There are known electric power tools in which settings of operating conditions, such as a maximum value and a minimum value of a screw fastening torque and starting characteristics of a motor rotation number with respect to an operation amount of a trigger switch, can be changed through an external device, such as a personal computer (see, for example, Patent Documents 1 and 2 below).

PRIOR ART DOCUMENTS

Patent Documents

Patent Document 1: Japanese Unexamined Patent Application Publication No. 2013-874

Patent Document 2: Japanese Unexamined Patent Application Publication No. 2013-184266

SUMMARY OF THE INVENTION

Problems to be Solved by the Invention

To change the settings of the operating conditions in the aforementioned electric power tool, it is required for a user of the electric power tool to understand settable item and settable range.

For that purpose, the user is required to find out the settable item and the settable range through a manual of the electric power tool, its manufacturer's website, or the like; thus, there is a disadvantage that the aforementioned electric power tool requires a burdensome preparation before setting the operating conditions.

In one aspect of the present invention, it is desirable in an electric power tool or a peripheral device thereof, to which operating conditions can be set using an external device, that a user can change settings of operating conditions easily and properly without finding out settable item or settable range.

Means for Solving the Problems

In an apparatus for an electric power tool in one aspect of the present invention, a controller controls an operation of the apparatus in accordance with operating conditions that are previously set.

With respect to an operating condition whose setting is changeable, among the operating conditions to be used for controlling by the controller, settable item and settable range of the operating condition are previously stored in a storage device.

The controller reads the settable item and the settable range from the storage device in accordance with a request from the external device received by a communication device, and transmits the settable item and the settable range to the external device through the communication device.

Accordingly, to change setting of the operating condition of the apparatus for an electric power tool using an external device, a user can easily understand the settable item and the settable range of the operating condition without finding out the settable item and the settable range of the operating condition using a manual of the apparatus for an electric power tool, or the like.

Also, since the settable item and the settable range of the operating condition are directly notified from the apparatus for an electric power tool, the user can know these parameters accurately, and thus incorrect setting of the operating condition of the apparatus for an electric power tool can be inhibited.

The controller may be configured not only to transmit the settable item and the settable range of the operating condition, but also to determine, if a change request of the operating condition transmitted from the external device is received by the communication device, whether the change request corresponds to the settable item and the settable range stored in the storage device.

In this case, the controller may be configured to change a setting of the operating condition in accordance with the change request if the change request corresponds to the settable item and the settable range, whereas to either prohibit change of the setting of the operating condition or correct the change request and then change the setting of the operating condition if the change request does not correspond to the settable item and the settable range.

Accordingly, this enables to inhibit incorrect setting of the operating condition more surely.

If the change request from the external device corresponds to the settable item and is outside the settable range, the controller may set the operating condition to one of an upper limit value and a lower limit value that is closest to the change request within the settable range in accordance with the change request.

With this configuration, if the user erroneously inputs a change request to the operating condition outside the settable range through the external device, the operating condition corresponding to the change request will be automatically changed to an operating condition that is closest to the change request within the settable range.

In this case, therefore, it is possible to change the setting of the operating condition of the apparatus for an electric power tool according to the user's intention, and thus to improve usability of the apparatus for an electric power tool.

Also, the controller may notify, if the change request from the external device does not correspond to at least one of the settable item or the settable range, the non-correspondence through a notification device. This allows the user to detect incorrect setting of the operating condition and to set the operating condition again.

The storage device may additionally store a settable step value that is a minimum unit when changing the setting of the operating condition, and the controller may also transmit the settable step value when transmitting the settable item and the settable range to the external device in accordance with the request from the external device.

With this configuration, in a case where, for example, the settable range of the rotation number of the motor is "20000 rpm to 5000 rpm" and the settable step value is "1000 rpm,"

the user may confirm the settable step value and set the rotation number of the motor by "1000 rpm."

That is, when changing the setting of the operating condition, the user can change the setting of the operating condition by the settable step value, and can perform setting of the operating condition easily and accurately.

In a case where the controller changes the setting of the operating condition in accordance with the change request from the external device, and if a change value of the operating condition specified by the change request does not correspond to the settable step value, the controller may correct the change value to a change value corresponding to the settable step value and change the setting of the operating condition.

With this configuration, in a case where, for example, the settable range of the rotation number of the motor is "20000 rpm to 5000 rpm," and the settable step value is "1000 rpm," and if the user specifies "7800 rpm" as a change value of the rotation number of the motor, the setting of the rotation number of the motor will be changed to "8000 rpm" corresponding to the settable step value.

Thus, in this case, when the operating condition is to be changed in accordance with a change request by the user, and if the change request does not correspond to the settable step value, the setting of the operating condition can be changed to a proper value in accordance with the user's intention.

Also, the controller may stop the operation of the apparatus for the electric power tool if a change request of the operating condition transmitted from the external device is received by the communication device while controlling the operation of the apparatus for an electric power tool.

This enables to inhibit abnormal operation of the apparatus for an electric power tool caused by a change of the operating condition in accordance with the change request from the external device during operation of the apparatus for an electric power tool.

Further, in the present invention, the communication device may be configured to perform a near field wireless communication with the external device.

Specifically, as the near field wireless communication, there is known NFC (Near Field Communication) that is a communication system for IC cards in accordance with International Standards ISO/IEC 14443, Japanese Industrial Standards JISX6319-4, and others.

Since this communication system is already in practical use and is installed in portable terminals, such as mobile phones and smartphones, downsizing and cost reduction of the communication device can be achieved by employing a communication device for the near field wireless communication (NFC).

Also, in this case, a portable terminal can be used as the external device, and thus the user can change the setting of the operating condition of an electric power tool using the user's own portable terminal.

The apparatus for an electric power tool may be included in, for example, an electric power tool, a battery configured to be attached to the electric power tool, or a charger configured to charge the battery.

BRIEF DESCRIPTION OF THE DRAWINGS

FIG. 4 is an explanatory diagram showing formats of data transmitted/received between an external device and the electric power tool.

FIG. 5 is an explanatory diagram showing one example of commands transmitted from the external terminal.

FIG. 6 is an explanatory diagram showing one example of data transmitted from the electric power tool in response to the commands in FIG. 5.

EXPLANATION OF REFERENCE NUMERALS

2 . . . rechargeable screwdriver, 4 . . . main body, 6 . . . angle head, 8 . . . battery pack, 12 . . . motor 12*a* . . . rotation sensor, 14 . . . operation device, 16 . . . grip, 18 . . . notification device, 20 . . . control circuit, 22 . . . motor drive device, 24 . . . current detection device, 27 . . . nonvolatile memory, 28 . . . regulator, 30 . . . communication circuit, 32 . . . antenna portion, 34 . . . communication controller, 36 . . . RF interface, 38 . . . memory, 39 . . . serial interface, 40 . . . connector, 50 . . . external terminal.

MODE FOR CARRYING OUT THE INVENTION

Hereinafter, an example embodiment of the present invention will be described with reference to the drawings.

Figure 1:
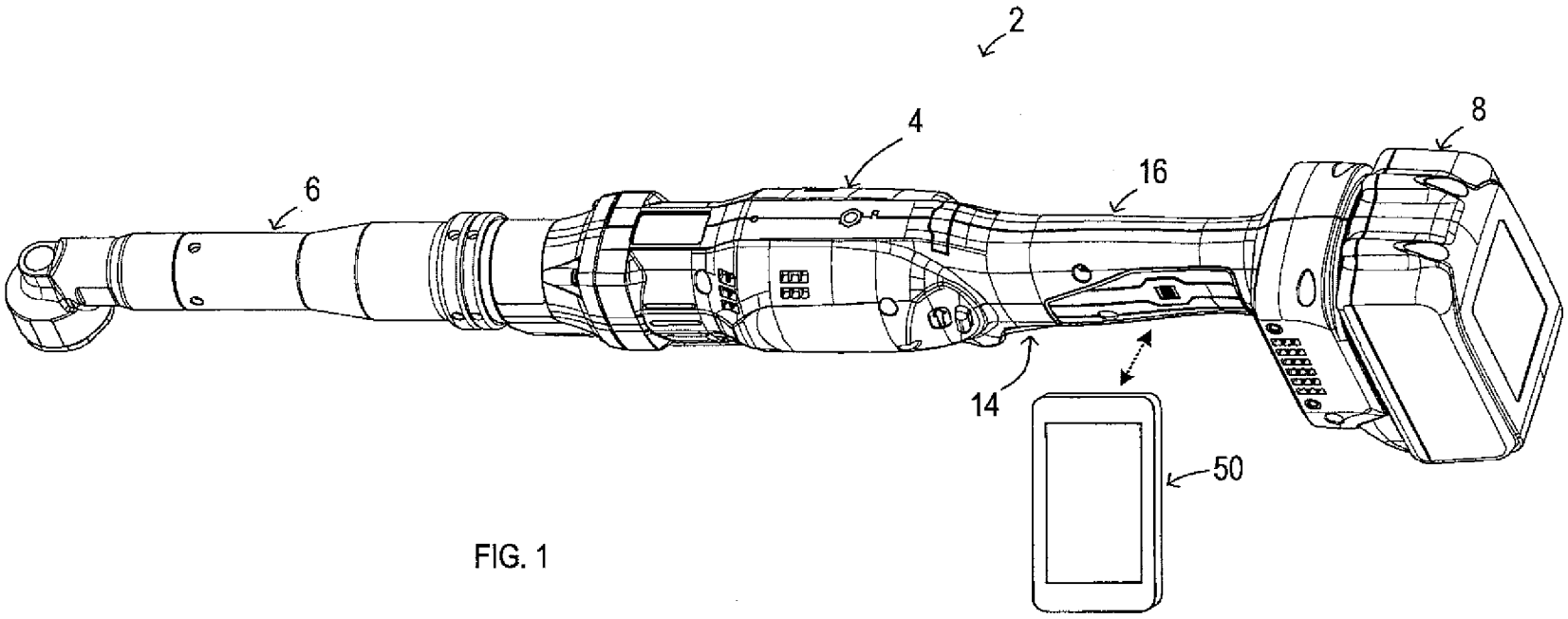
FIG. 1 is a perspective view showing an appearance of an electric power tool of an embodiment.

As shown in FIG. 1, an electric power tool of the present embodiment is configured as a rechargeable screwdriver (hereinafter simply referred to as a "driver") 2. The driver 2 comprises a main body 4 having an elongated shape, an angle head 6 detachably attached to one end portion in a longitudinal direction of the main body 4, and a battery pack 8 detachably attached to the other end portion in the longitudinal direction of the main body 4.

In the one end portion of the main body 4 to which the angle head 6 is attached, a motor 12 (see FIG. 2) to rotationally drive the angle head 6 is installed. The angle head 6 converts a rotation of the motor 12 with a rotation axis to a rotation with a rotation axis in a different direction through an inner gear mechanism, and then transmits the rotation to a front end tool.

In the middle of the main body 4, there is provided an operation device 14 for a user of the driver 2 to input a drive command of the motor 12 through an external operation. Also, a grip 16 is provided between the operation device 14 and an attachment portion of the battery pack 8, in order to enable the user to operate the operation device 14, for example, with a pointing finger while gripping the main body 4.

Figure 2:
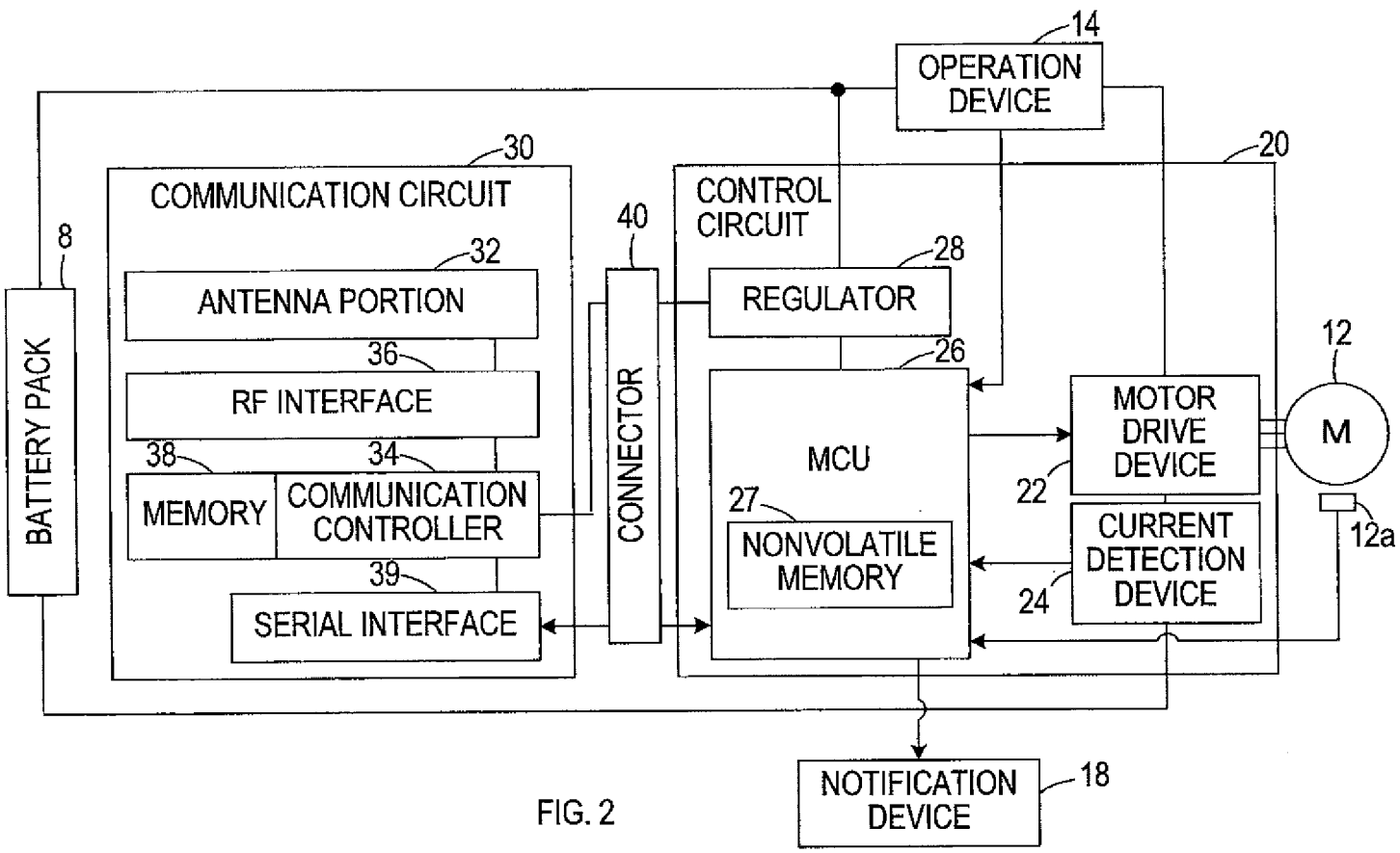
FIG. 2 is a block diagram showing a circuit configuration of the electric power tool.

The main body 4 houses therein a control circuit 20 and a communication circuit 30 shown in FIG. 2 in addition to the motor 12.

The control circuit 20 is configured to operate by receiving power supply from the battery pack 8 to control driving of the motor 12 in accordance with a command from the operation device 14.

Specifically, the control circuit 20 comprises a motor drive device 22 that supplies current to the motor 12 (a brushless motor in the present embodiment) to thereby drive the motor 12, a current detection device 24 that detects current flowing into the motor 12, and an MCU (Micro Control Unit) 26.

The MCU 26 controls the motor 12, through the motor drive device 22, based on detection signals from a rotation sensor 12*a* provided to the motor 12 and from the current detection device 24 so that the motor 12 rotates in accordance with the command from the operation device 14.

In order to perform such control, the MCU 26 comprises a nonvolatile memory 27 to store operating conditions (such as a rotation speed (speed) and a rotation amount (turns) of the motor 12) and respective setting changeable ranges (such as an upper limit value, a lower limit value, and a settable step value) when performing a screw fastening operation by the driver 2.

The nonvolatile memory 27 corresponds to one example of a storage device of the present invention, the control circuit 20 corresponds to one example of a controller of the present invention, and the communication circuit 30 corresponds to one example of a communication device of the present invention.

The control circuit 20 comprises a regulator 28 configured to receive power supply from the battery pack 8 and provide a power-supply voltage (a direct current constant voltage) to the MUC 26. Also, a notification device 18 to notify a user of various operating states is coupled to the MCU 26. The notification device 18 comprises a buzzer, an LED, and the like.

The communication circuit 30, which is configured to perform near field wireless communication of the NFC system with an external terminal 50 (see FIG. 1) such as a smartphone, comprises an antenna portion 32, a communication controller 34, and an RF interface 36 that couples these components.

The communication circuit 30 also comprises a memory 38 to store various information necessary for communication with the external terminal 50 and a serial interface 39 to perform data communication with the MCU 26 of the control circuit 20.

The communication controller 34 controls data to communicate information for communication that is stored in the memory 38 between the RF interface 36 and the serial interface 39. Accordingly, the communication controller 34 performs a near field wireless communication with the external terminal 50, and communicates with the MUC 26 data transmitted and received to and from the external terminal 50 by the near field wireless communication, to thereby relay communication between the MCU 26 and the external terminal 50.

The control circuit 20 and the communication circuit 30 are configured by mounting electronic components onto respective different circuit substrates, and these components are coupled through the connector 40.

Specifically, the connector 40 couples a communication line between a communication port of the MCU 26 and the serial interface 39 of the communication circuit 30, as well as a power line to supply power from the regulator 28 to the communication controller 34.

The circuit substrate of the communication circuit 30 is housed in the grip 16 of the main body 4, and communication between the external terminal 50 and the communication circuit 30 is enabled by moving the external terminal 50 close to the grip 16.

The near field wireless communication of the NFC system is a technology to read data from an IC card and to write data to an IC card.

Figure 3A:
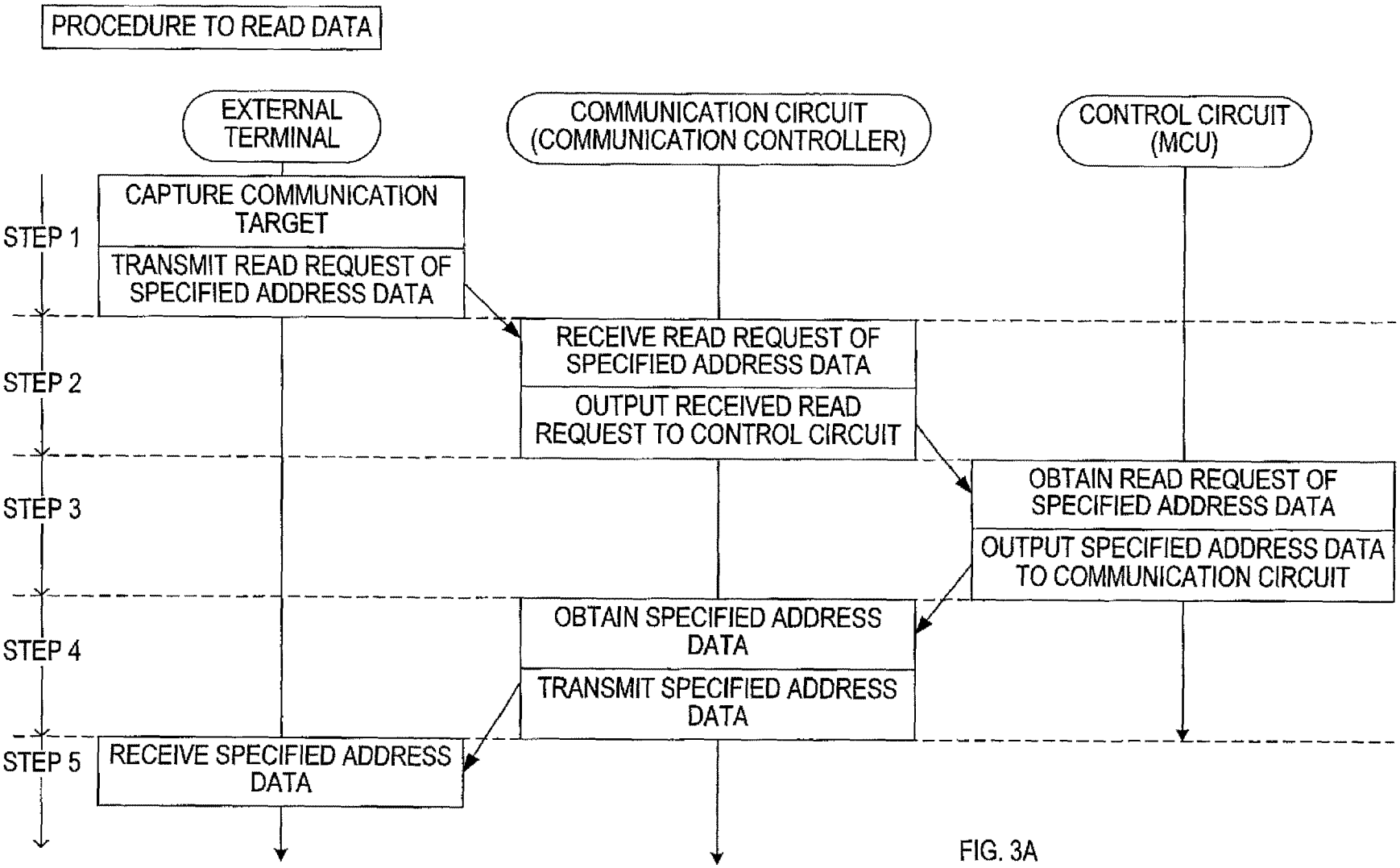
FIG. 3A is an operation explanatory diagram showing operations of a communication circuit and a control circuit in response to a read request from an external terminal.
Figure 3B:
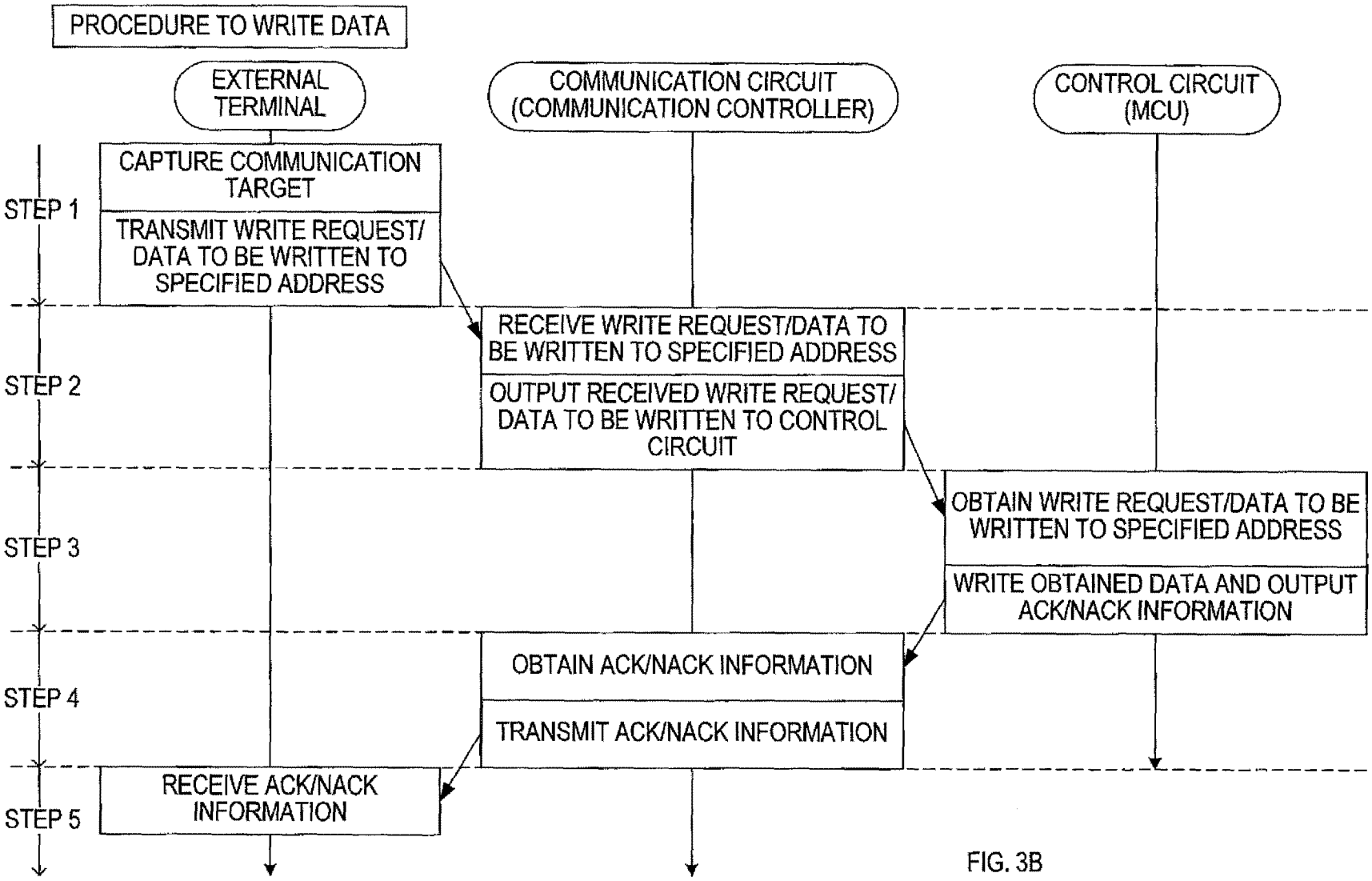
FIG. 3B is an operation explanatory diagram showing operations of the communication circuit and the control circuit in response to a write request from the external terminal.

Accordingly, in the present embodiment, it is possible by using the external terminal 50 to read operating conditions of the motor 12 stored in the nonvolatile memory 27 according to a procedure shown in FIG. 3A, and to write operating conditions of the motor 12 according to a procedure shown in FIG. 3B.

Specifically, to read control information by using the external terminal 50, the external terminal 50 is first moved close to the grip 16 to be caused to capture the communication circuit 30 as a communication target, and then is caused to transmit a read request of desired data (specified address data) stored at a specified address of the nonvolatile memory 27 from the external terminal 50 to the communication circuit 30 (Step 1 in FIG. 3A).

Then, the communication controller 34 of the communication circuit 30 receives the read request, and outputs (transfers) the read request to the control circuit 20 through the serial interface 39 (Step 2 in FIG. 3A).

As a result, in the control circuit 20, the MCU 26 obtains the read request from the external terminal 50, reads the specified address data corresponding to the read request from the nonvolatile memory 27, and outputs the specified address data to the communication circuit 30 (Step 3 in FIG. 3A).

Then, in the communication circuit 30, the communication controller 34 obtains the specified address data from the control circuit 20, and transmits the obtained specified address data to the external terminal 50 (Step 4 in FIG. 3A).

As a result, the external terminal 50 can obtain the specified address data as requested (Step 5 in FIG. 3A).

To write control information by using the external terminal 50, after the external terminal 50 is caused to capture the communication circuit 30 in the same manner as aforementioned, the external terminal 50 is caused to transmit to the communication circuit 30 from the external terminal 50 a write request of data to a specified address together with data to be written (Step 1 in FIG. 3B).

Then, the communication controller 34 of the communication circuit 30 receives the write request and data, and outputs (transfers) the same to the control circuit 20 through the serial interface 39 (Step 2 in FIG. 3B).

As a result, in the control circuit 20, the MCU 26 obtains the write request and data from the external terminal 50, writes the obtained data to the specified address of the nonvolatile memory 27, and outputs Ack/Nack information indicating a result of writing (Step 3 in FIG. 3B).

Then, in the communication circuit 30, the communication controller 34 obtains the Ack/Nack information from the control circuit 20, and transmits the obtained Ack/Nack information to the external terminal 50 (Step 4 in FIG. 3B).

As a result, the external terminal 50 receives the Ack/Nack information and is able to confirm whether the data transmitted together with the write request has been properly written (Step 5 in FIG. 3B).

In the near field wireless communication of the NFC system, there are definitions of formats of data to be transmitted/received when performing reading/writing of the data. Thus, in the present embodiment, transmission/reception among the external terminal 50, the communication circuit 30, and the control circuit 20 is performed by using data formats in accordance with the definitions as shown in FIG. 4.

It is to be noted that in the near field wireless communication of the NFC system, the first 2 bytes ("Address L" and "Address H" shown in FIG. 4) of transmission data are used to specify an address in a storage medium when making a read request/write request from the external terminal 50. In this case, since a specifiable address occupies an area of substantially half of the 2 bytes, that is 8 bits, there is only an extremely small storage area from/to which reading/writing of data is possible in the storage medium.

In the present embodiment, therefore, it is configured to specify an address from or to which reading or writing of data is to be performed by using data area (16 bytes of "Data0" to "Data15" shown in FIG. 4) for writing assigned to the transmission data when making a write request, without changing data formats.

Specifically, as shown in Item (1) of FIG. 5, the external terminal 50 transmits at most six commands (C1 to C6 shown in FIG. 5) each making a reading or writing request of information at a specified address, the number of commands, and an authentication key by using a data areas ("Data0" to "Data15") of transmission data when making a write request as shown in FIG. 4 in 2-byte units.

In the present embodiment, the commands C1 to C6 are each used for specifying an address of data to be read from or written to the nonvolatile memory 27.

As a result of the transmission of the commands, the MCU 26 in the control circuit 20 stores the received plurality of commands C1 to C6 and returns Ack/Nack information indicating reception of the commands as shown in Item (1) in FIG. 6 through the communication circuit 30.

Subsequently, the external terminal 50 sequentially transmits read commands or write commands of data corresponding to the plurality of commands (C1 to C6) previously transmitted, as shown in Items (2) to (7) in FIG. 5.

Specifically, if the previously transmitted command is an address of information to be read from the nonvolatile memory 27, a read command of data at the previously specified address is transmitted as shown in Items (2) to (6) in FIG. 5, using the format for transmission data when making a write request shown in FIG. 4.

Then, the MCU 26 of the control circuit 20, as shown in Items (2) to (6) in FIG. 6, reads from the nonvolatile memory 27 information at the address corresponding to the previously received command, and returns read data using the data format when returning read data as shown in FIG. 4.

If the previously transmitted command is an address of information to be written to the nonvolatile memory 27, the external terminal 50 transmits write data as shown in Item (7) in FIG. 5 using the format for transmission data when making a write request shown in FIG. 4.

Then, the MCU 26 in the control circuit 20 writes received data at the address of the nonvolatile memory 27 corresponding to the previously received command, and returns a result of the writing (i.e., Ack/Nack information) as shown in Item (7) in FIG. 6.

Consequently, according to the present embodiment, it is possible to specify a wider range of addresses in the nonvolatile memory 27, and to execute reading or writing of information from or to the nonvolatile memory 27 by using the communication circuit 30 of a common type that performs the near field wireless communication of the NFC system.

As clear from FIG. 5, it is possible in the present embodiment to specify, as information to be read from the nonvolatile memory 27, specific information of the electric power tool, upper limit value information, lower limit value information, settable step information, and current tool setting information by using the commands C1 to C5.

The upper limit value information and the lower limit value information are information indicating an upper limit value and a lower limit value that are settable as operating conditions, the settable step information is information indicating a minimum unit to change setting of each operating condition, and the current tool setting information is information indicating currently set operating conditions.

Also, it is possible to set, as information to be written to the nonvolatile memory 27, new tool setting information to update the operating conditions by the command C6.

When setting the new tool setting information, a user can set the new tool setting information properly by confirming the upper limit value information, the lower limit value information, and the settable step information that are read from the nonvolatile memory 27.

Further, as clear from FIG. 6, the specific information of the electric power tool obtainable by the command C1 comprises a product name, a type of a motor, a rated voltage, a control specification, a serial number, etc.

The operating conditions that can be read by the commands C2 to C5 and be written by the command C6 are a rotation speed (First speed) and a rotation amount (First turns) of the motor 12 immediately after starting a screw fastening, a rotation speed (Rundown speed) and a rotation amount (Rundown turns) of the motor 12 during the screw fastening, and a rotation speed (Final speed) and a rotation amount (Final turns) of the motor 12 when finishing the screw fastening.

Figure 7:
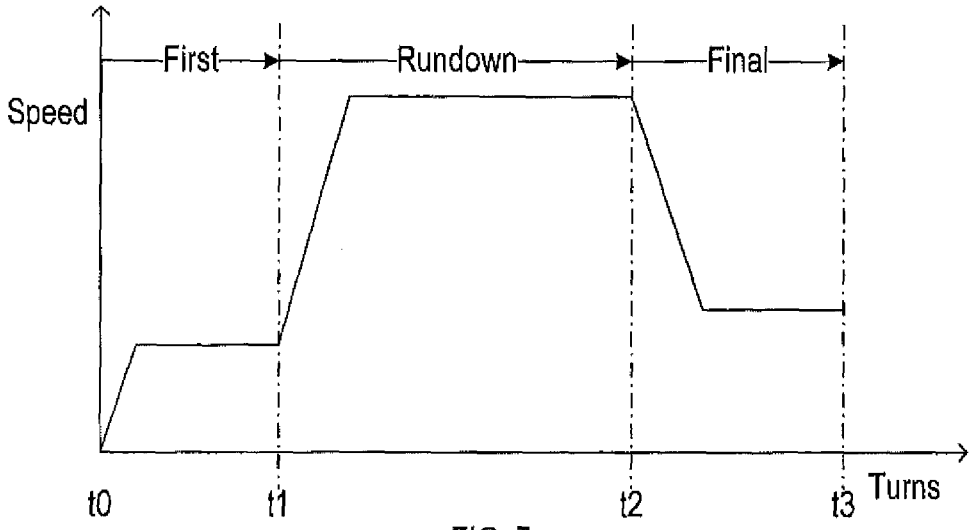
FIG. 7 is an explanatory diagram illustrating tool information transmitted/received between the external device and the electric power tool.

Specifically, in a case of performing a specified screw fastening using the driver 2, for example, in a manufacturing facility or the like, the motor 12 is rotated at a specified low speed from the start of screw fastening at a time point t0 until a time point t1 by which a screw has been rotated a specified amount, as shown in FIG. 7.

Thereafter, the motor 12 is rotated at a high speed to perform screw fastening, and the motor is rotated at a low speed after the screw fastening is mostly completed (at a time point t2) until a time point t3 by which the screw has been further rotated a specified amount in order to completely fasten the screw.

In order to properly perform such a screw fastening operation, the aforementioned various operating conditions (First speed, First turns, Rundown speed, Rundown turns, Final speed, and Final turns) are defined in the driver 2 of the present embodiment.

Also, to enable setting changes of these operating conditions by using the external terminal 50, the operating conditions and respective settable ranges thereof (the upper limit values, the lower limit values, and the settable step values) are stored in the nonvolatile memory 27.

In the transmission data from the external terminal 50 shown in FIG. 5, the head frame of 2 bytes ("Address L", "Address H") are not used for specifying an address.

In the present embodiment, therefore, as described in Item (1) in FIG. 5, 3 bits (b5, b6, b7) of the head frame are used to transmit, from the external terminal 50, flags F_T1 and F_T2 to be used in a later-described communication process as well as a flag F_write indicating whether the transmission data is a write request or a read request. Also, an authentication key of 4 bits that is specific to the external terminal 50 is assigned to the head frame.

Next, a description will be given of a control process to be executed by the MCU 26 of the control circuit 20 to perform drive control of the motor 12, and reading and writing of information from and to the nonvolatile memory 27 in accordance with requests from the external terminal 50, with reference to flowcharts in FIGS. 8, 9, 10A, 10B, and 11.

Figure 8:
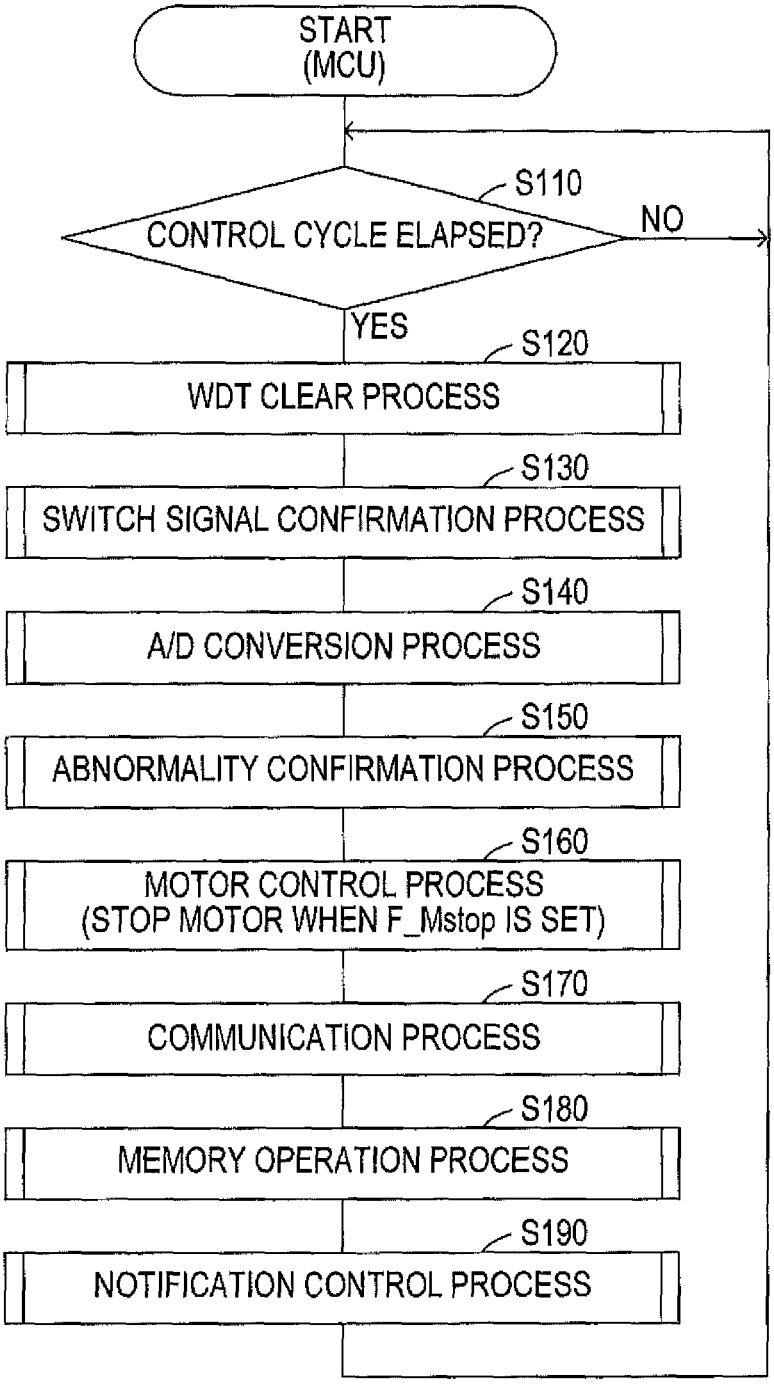
FIG. 8 is a flowchart showing a control process executed by a control circuit (MCU) of the electric power tool.

As shown in FIG. 8, the MCU 26 determines in S110 (S means "Step") whether a specified control cycle has elapsed. If the specified control cycle has not elapsed, a determination process in S110 is executed again, and elapse of the specified control cycle is waited for.

When the specified control cycle has elapsed, processes in S120 onward are executed. That is, the MCU 26 periodically executes the processes in S120 onward with the specified control cycle.

In S120, a WDT clear process to clear a watch dog timer (WDT) is executed, and in subsequent S130, a signal (a switch signal) from an operation switch provided to the operation device 14 is confirmed.

In subsequent S140, an A/D conversion process is executed, in which an operation amount of the operation device 14, a current detected by the current detection device 24 and a battery voltage supplied by the battery pack 8, detection signals from the rotation sensor 12*a* provided to the motor 12, a not-shown temperature sensor, and the like, are A/D converted and acquired.

In subsequent S150, an abnormality confirmation process is executed, in which an abnormality, such as battery voltage reduction and overheat of the motor 12, is checked based on results of the A/D conversion in S140. In subsequent S160, a motor control process to control the driving of the motor 12 is executed.

In the motor control process, in a case where an abnormality is detected in the abnormality confirmation process, the driving of the motor 12 is stopped, and then a drive stopped state is maintained until a user's operation of the operation device 14 is finished. In the motor control process, the driving of the motor 12 is stopped also in a case where a flag F_Mstop to be set or reset (cleared) in a later-described communication process is set.

Subsequently, in S170, a communication process is executed, in which a write request or read request inputted from the external terminal 50 through the communication circuit 30 is received, and a result of writing or read information is returned.

In subsequent S180, a memory operation process to write data to the nonvolatile memory 27 or to read data from the nonvolatile memory 27 is executed based on the communication process in S170.

Finally, after proceeding to S190, a notification control process is executed, in which an abnormality detected in the abnormality confirmation process or an abnormality in the write data obtained in the communication process is notified to a user through the notification device 18, and the present process proceeds to S110.

Figure 9:
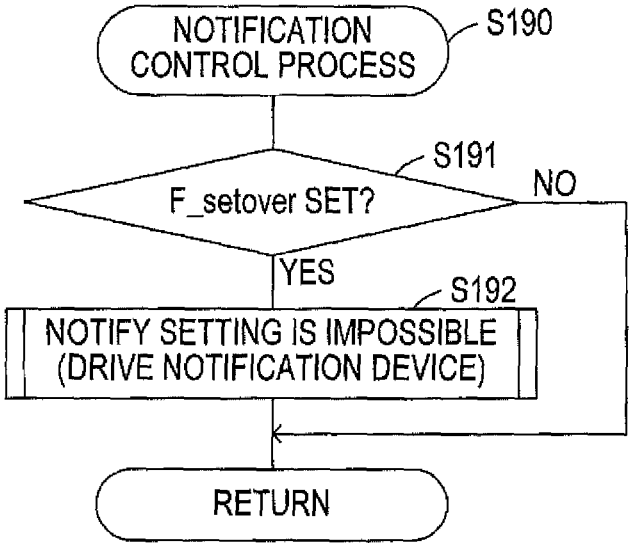
FIG. 9 is a flowchart showing a notification control process shown in FIG. 8.

As shown in FIG. 9, in the notification control process, it is determined in S191 whether a flag F setover to be set or reset (cleared) in the communication process is set, to thereby determine whether the update data of the operating condition obtained in the communication process is within an updatable range defined by the upper or lower limit value information or the settable step information shown in FIG. 6.

If the flag F_setover is set, the present process proceeds to S192, in which the notification device 18 is driven to notify such flag setting. Since the notification device 18 comprises the buzzer, the LED, and the like, as described above, the fact that the update data is outside the updatable range (in other words, updating by the update data is impossible) is notified to the user in S192 by means of sounding of the buzzer and lighting (or blinking) of the LED.

If the flag F_setover is not set, the notification control process is terminated.

Next, a description will be given of the communication process (S170) that is a major process in the present invention.

Figure 10A:
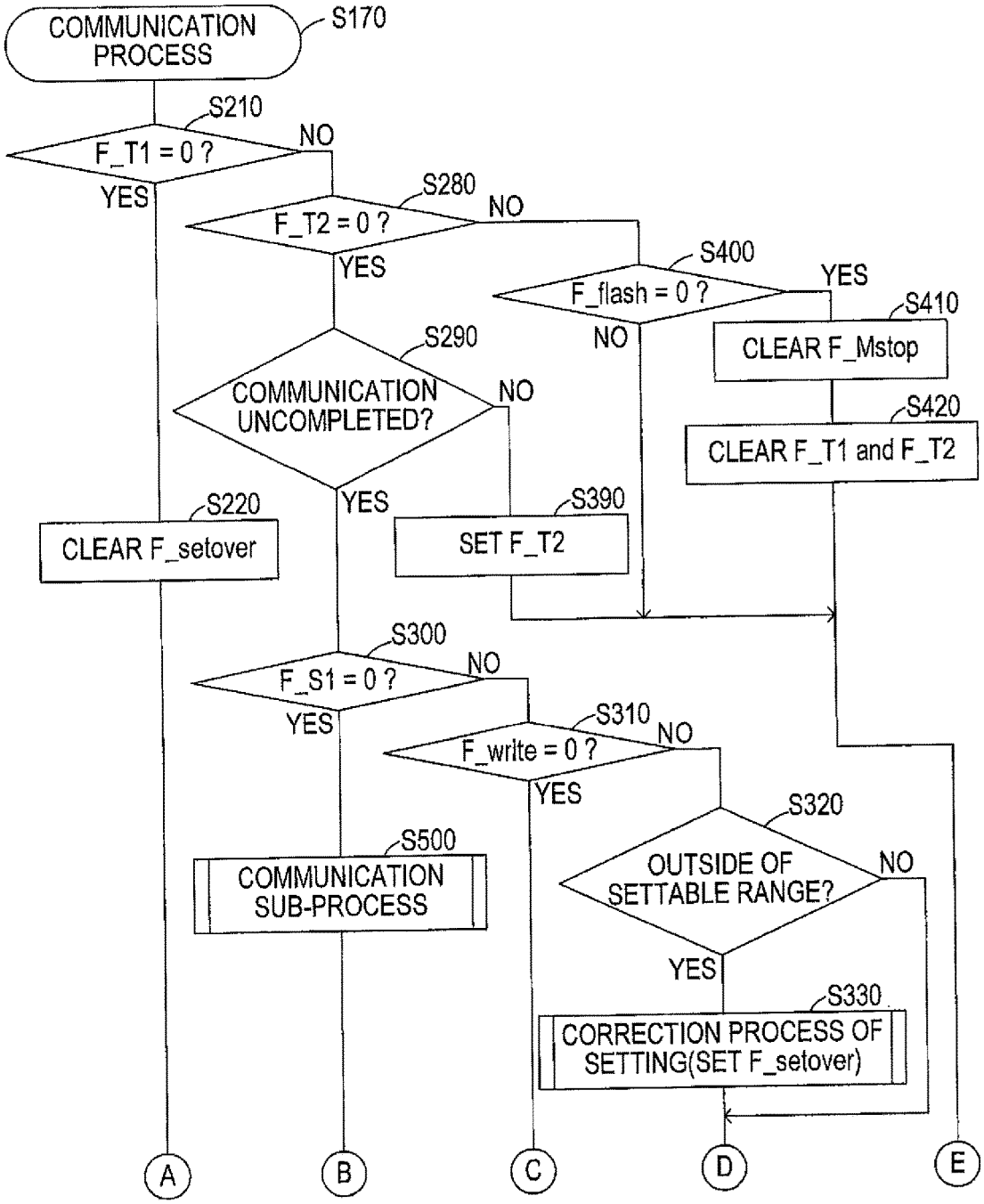
FIG. 10A is a flowchart showing a part of a communication process shown in FIG. 8.
Figure 10B:
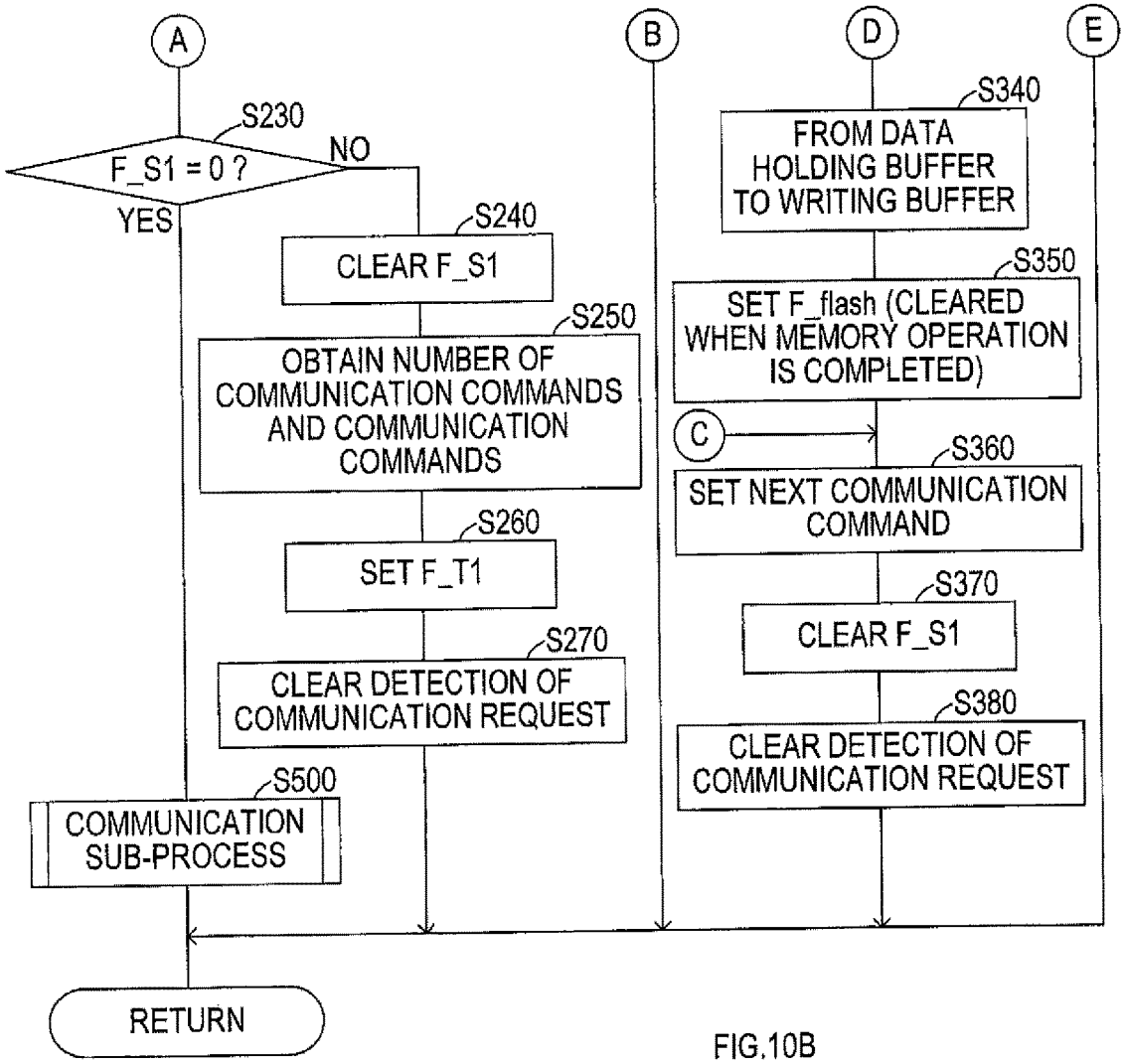
FIG. 10B is a flowchart showing the remaining part of the communication process.

As shown in FIGS. 10A and 10B, in the communication process, it is determined in S210 whether a flag F_T1 is cleared to a value "0". The flag F_T1 is set to a cleared state from when first transmission data indicating the plurality of commands C1 to C6 shown in Item (1) in FIG. 5 is received until when a reception process thereof (that is, a reply) is completed, by a later-described process and the transmission data from the external terminal 50.

Accordingly, in S210, from when the first transmission data shown in Item (1) in FIG. 5 is received until when the reception process (that is, a reply) is completed, a positive determination is made and the present process proceeds to S220.

In S220, the flag F_setover is cleared, and the present process proceeds to S230, in which it is determined whether a flag F_S1 is cleared.

The flag F_S1 is a flag that is set when a series of processes from a write request or a read request (hereinafter also collectively referred to as a communication request) from the external terminal 50 to a reply in a communication sub-process in S500 is completed, and then is cleared when a waiting state for a next communication request is started.

Accordingly, in S230, from when the first transmission data shown in Item (1) in FIG. 5 is received until when the reception process (that is, a reply) is completed, a positive determination is made in the same manner as in S210 and the communication sub-process in S500 is executed. After executing the communication sub-process, the communication process is terminated.

Figure 11:
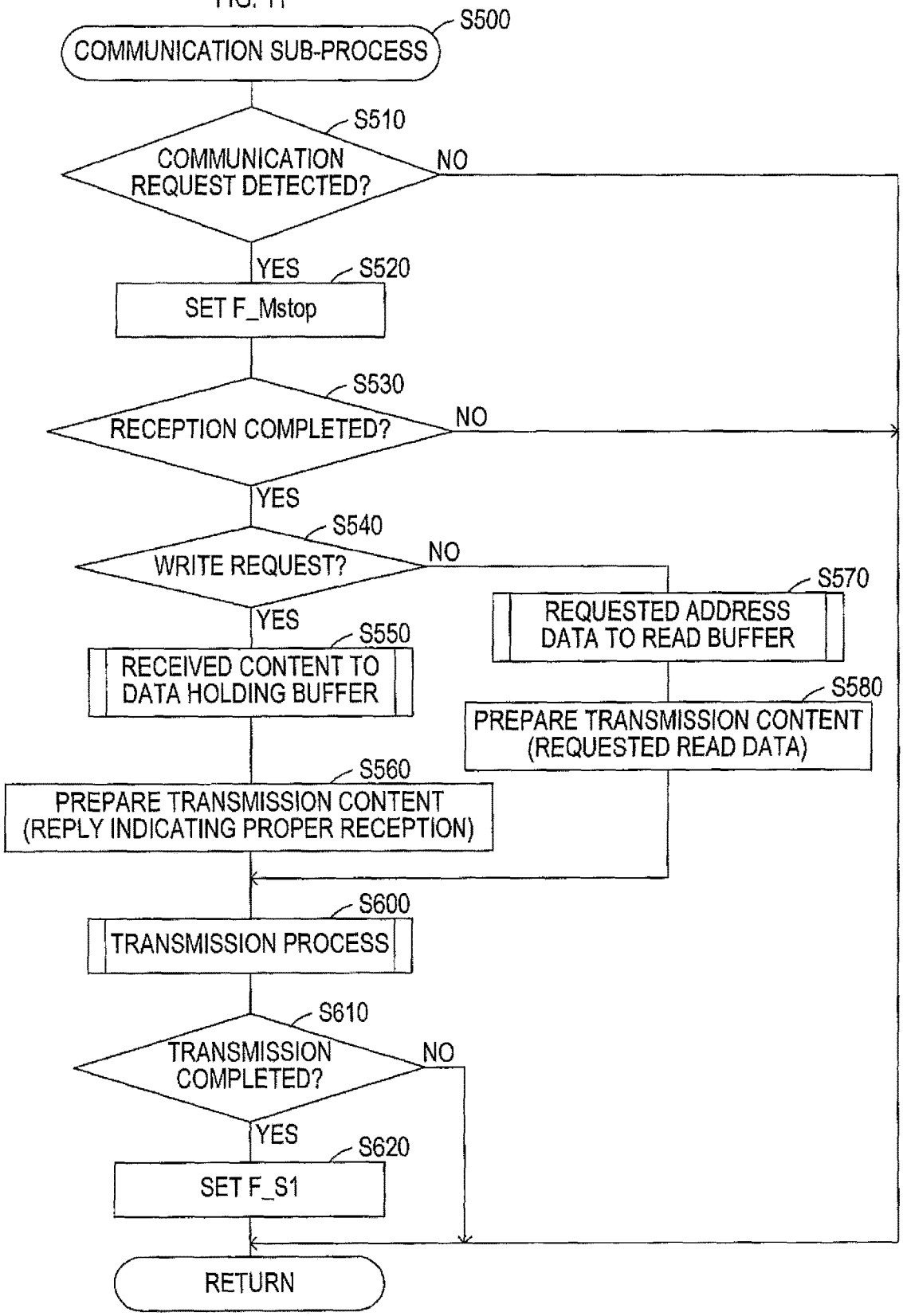
FIG. 11 is a flowchart showing a communication subprocess shown in FIG. 10B.

The communication sub-process, which is a process to execute a series of processes from reading or writing of data from or to the nonvolatile memory in accordance with the communication request from the external terminal 50 shown in Items (1) to (7) in FIG. 5 until returning the results (the information shown in Item (1) to (7) in FIG. 5), is performed according to a procedure shown in FIG. 11.

Specifically, in the communication sub-process, it is determined in S510 whether a communication request from the external terminal 50 is inputted through the communication circuit 30. If a communication request is not inputted, the communication sub-process is simply terminated, whereas if a communication request is inputted, the present process proceeds to S520.

In S520, a flag F_Mstop is set to stop the driving of the motor 12, and in subsequent S530, it is determined whether reception of all data of the communication request from the external terminal 50 is completed.

If reception of all data of the communication request is not completed, the communication sub-process is terminated, whereas if reception of all data of the communication request is completed, the present process proceeds to S540.

In S540, it is determined based on the flag F_write of the head frame of the received data whether the currently received communication request is a write request or a read request.

If the currently received communication request is a write request, the present process proceeds to S550, in which a received content is written to a data holding buffer. In subsequent S560, a transmission content (the Ack/Nack information shown in Items (1) and (7) in FIG. 6) to reply indicating that write data has been properly received is prepared, and then the present process proceeds to S600.

If the currently received communication request is a read request, the present process proceeds to S570, in which an address of data to be read from the nonvolatile memory 27 in accordance with the read request (in other words, an address specified by each of the commands C1 to C5 shown in FIG. 5) is written to a read buffer.

Then, data of the address written to the read buffer is read from the nonvolatile memory 27 in the memory operation process in S180. In subsequent S580, a transmission content (the information shown in Items (2) to (6) in FIG. 6) to return the read data to the external terminal 50 is prepared, and then the present process proceeds to S600.

In S600, a transmission process is executed, in which the information prepared in S560 or S580 is outputted to the communication circuit 30, to thereby cause the communication circuit 30 to transmit (return) the information to the external terminal 50.

In S610, it is determined whether the transmission process in S600 is completed. If the transmission process is completed, the flag F_S1 is set, and the communication sub-process is terminated. If it is determined in S610 that the transmission process is not completed, the communication sub-process is temporarily terminated.

When the flag F_S1 is set in the communication sub-process as described above, a negative determination is made in S230, and the subsequent S240 is executed.

In S240, the flag F_S1 is cleared, and in S250, the number of communication commands and the communication commands are obtained from the transmission data (in this case, the initial transmission data shown in Item (1) in FIG. 5) that is obtained in the communication sub-process in S500.

In subsequent S260, the flag F_T1 is set, and in S270, a detection state of a communication request in the communication sub-process is cleared, and the present communication process is terminated.

When the number of communication commands and the communication commands are obtained as described above, the flag F_T1 is set; thus, a negative determination is to be made in S210 in the communication process. When a negative determination is made in S210, the present process proceeds to S280, in which it is determined whether a flag F_T2 is cleared to a value "0."

The flag F_T2 is set to a cleared state until later-described processes as well as the plurality of commands C1 to C6 initially transmitted from the external terminal 50 by the transmission data from the external terminal 50 are all completely executed.

Accordingly, in S280, a positive determination is made until the plurality of commands are completely executed, and then the present process proceeds to S290. In S290, it is determined whether communications for the number of communication commands obtained in S250 are not completed, in other words, processes corresponding to the initially obtained plurality of communication commands still remain.

If communications for the number of communication commands are not completed and commands to be executed still remain, the present process proceeds to S300, in which it is determined whether the flag F_S1 is cleared. If the flag F_S1 is cleared, the communication sub-process in S500 is executed.

In the communication sub-process executed at that point, reception of the initial transmission data from the external terminal 50 (that is, reception of the number of communication commands and of the communication commands) is completed.

Accordingly, in the communication sub-process to be executed when a positive determination is made in S300, an execution command of each of the commands included in the initial transmission data is received as a communication request, and writing or reading of information to or from the nonvolatile memory 27 is performed in response to the execution command.

It is to be noted that when it is determined in S510, after obtaining the plurality of commands by the initial transmission data, whether a communication request is received, a comparison is made between the authentication key assigned to the head frame of the initial transmission data and an authentication key assigned to the head frame of the currently received communication request. If these are identical, it is determined that an execution command of the command is received.

This is intended to inhibit erroneous operation caused by a transmission signal from an external device different from the external terminal 50 that initially transmitted the plurality of commands.

If it is determined in S300 that the flag F_S1 is set, this means that it is immediately after a communication with respect to one of the commands is completed by the communication sub-process, and thus the present process proceeds to S310. In S310, it is determined whether the flag F_write of the head frame of the currently received data is cleared, in other words, whether the communication request is a read request.

If the flag F_write is cleared, and the communication request is a read request, the present process proceeds to S360, in which a communication command to be executed next is set. In S360, if communications for the number of communication commands are completed, and thus any next communication command cannot be set, such fact is stored for the determination process in S290.

In subsequent S370, the flag F_S1 is cleared, and in S380, the detection state of a communication request in the communication sub-process is cleared, and the present communication process is terminated.

If it is determined in S310 that the flag F_write is set, the communication request is a write request, and thus the present process proceeds to S320.

In S320, it is determined whether the write data (in the present embodiment, new tool setting information shown in Item (7) in FIG. 5) that is stored to data holding buffer in the communication sub-process is within a settable range (upper and lower limit values), and also corresponds to a settable step value.

If it is determined in S320 that the write data is within the settable range and corresponds to the settable step value, the present process proceeds to S340.

If it is determined in S320 that the write data is outside the settable range or does not correspond to the settable step value, the present process proceeds to S330.

In S330, if the write data stored in the data holding buffer is outside the settable range, the write data is corrected to be a value closer to the currently received write data within the upper and lower limit values of the settable range, and the present process proceeds to S340.

If the write data does not correspond to the settable step value, the write data is corrected to a value closest to the currently received write data among values settable by the settable step value, and the present process proceeds to S340.

In S340, the write data in the data holding buffer is transferred to a writing buffer, and in S350, a flag F_flash is set. Then, the present process proceeds to S360.

The flag F_flash is cleared when the write data in the writing buffer is written to a specified address of the nonvolatile memory 27 corresponding to the command in the memory operation process in S180.

In a correction process in S330, it is impossible to write a setting value corresponding to the write request from the external terminal 50, and thus the flag F_setover is set to notify the fact to the user.

As a result, it is notified to the user through the notification device 18 by the notification control process shown in FIG. 9 that it is impossible to write a setting value corresponding to the write request, and the user can detect the fact.

If it is determined in S290 that the communications for the number of communication commands are completed, the present process proceeds to S390, in which the flag F_T2 is set, and then the present communication process is terminated.

If it is determined in S280 that the flag F_T2 is set, the present process proceeds to S400, in which it is determined whether the flag F_flash is cleared, in other words, whether writing of the write data to the nonvolatile memory 27 in the memory operation process in S180 is completed.

If it is determined in S400 that the flag F_flash is set, writing to the nonvolatile memory 27 is not completed, and thus the present communication process is simply terminated.

If it is determined in S400 that the flag F_flash is cleared, it means that processes corresponding to the plurality of commands transmitted from the external terminal 50 are all completed. Thus, the present process proceeds to S410, in which the flag F_Mstop is cleared to permit the driving of the motor 12 by the motor control process.

In subsequent S420, the flags F_T1 and F_T2 are cleared so that a series of memory operations corresponding to the communication request from the external terminal 50 can be executed, and then the present communication process is terminated.

As described above, in the driver 2 of the present embodiment, the nonvolatile memory 27 stores the operating conditions whose settings are changeable (First speed, First turns, Rundown speed, Rundown turns, Final speed, and Final turns), as well as the respective settable ranges (upper limit values, lower limit values), and the respective settable step values).

These parameters can be obtained by the external terminal 50 by sending a read request from the external terminal 50 through the near field wireless communication.

Accordingly, the user can confirm the operating conditions whose settings are changeable, the settable ranges and the settable step values through the external terminal 50. Also, when making a change request of an operating condition (a write request of new tool setting information), it is possible to specify, as a new setting value, a proper value within the settable range and corresponding to the settable step value.

Also, in the present embodiment, if the write data transmitted as a change request of an operating condition is outside the settable range of the operating condition or does not correspond to the settable step value, the write data is corrected to a value within the settable range and corresponding to the settable step value, and then stored in the nonvolatile memory 27. Accordingly, it is possible to change setting of the operating condition to a proper value depending on the user's intention, thereby to achieve an improved usability.

Further, in the present embodiment, if the write data transmitted as a change request of an operating condition is outside the settable range of the operating condition or does not correspond to the settable step value, a notification is provided to the user through the notification device 18. Accordingly, the user can detect an incorrect setting of the operating condition, and reset the operating condition.

Moreover, in the present embodiment, if a communication request from the external terminal 50 (in other words, a change request of an operating condition) is received, the flag F_Mstop is set to thereby stop the driving of the motor 12 by the motor control process. Accordingly, it is possible to inhibit a change of the operating condition during the driving of the motor 12 and resulting unstable driving of the motor 12.

Although the embodiment of the present invention has been described as above, the present invention is not limited to the aforementioned embodiment, but may be in various modes within the scope not departing from the subject matter of the present invention.

For example, in the aforementioned embodiment, it is described that in a case where write data transmitted as a change request of an operating condition is outside the settable range of the operating condition or does not correspond to the settable step value, the write data is corrected to a proper value; however, in this case, such a change of the operating condition may be prohibited.

For that purpose, it may be configured, for example, such that if it is determined in S320 that the write data is outside the settable range, the flag F_setover is set in S330, and then the present process proceeds to S360.

Also, in the aforementioned embodiment, the communication circuit 30 is described to perform the near field wireless communication with the external terminal 50, the communication circuit 30 may perform wireless communication according to a communication system different from the NFC system. The communication circuit 30 also may perform communication through a communication line, such as a LAN cable.

Further, the external device that performs communication with the communication circuit 30 may be a wireless communication device that is different from a portable terminal, such as a mobile phone or a smartphone, or may be an information processing apparatus, such as a personal computer.

Figure 12:
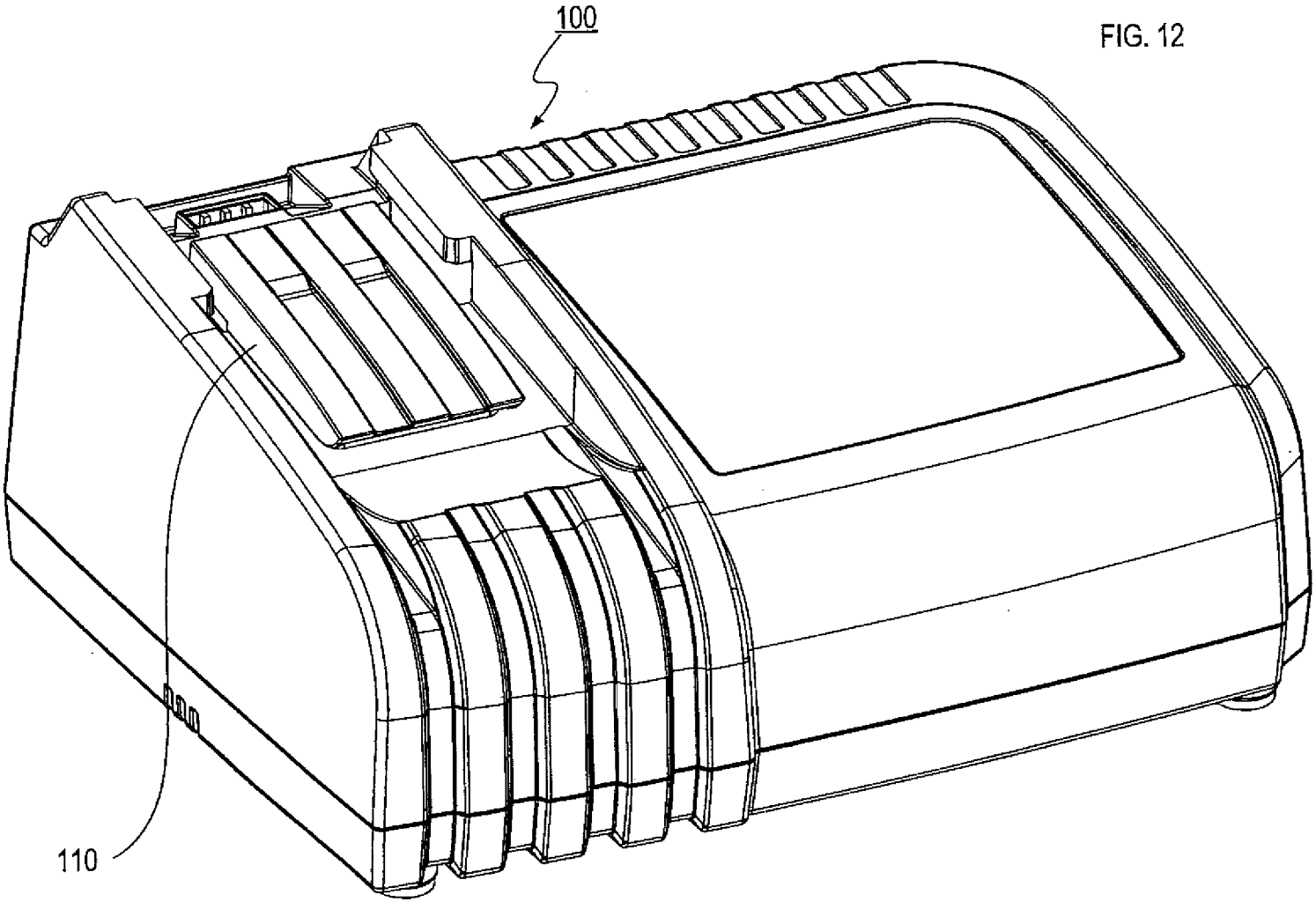
FIG. 12 is a perspective view showing an appearance of one example of a charger to which the present invention is applicable.

Moreover, the electric power tool, which is configured as the driver 2 in the aforementioned embodiment, may be configured as an electric power tool in a different form. The present invention may also be applied to a battery pack that provides power supply to the electric power tool, such as the battery pack 8 shown in FIG. 1, or a charger therefor, such as a charger 100 shown in FIG. 12, or may be applied to an apparatus that is different from these apparatuses for an electric power tool. The charger 100 shown in FIG. 12 comprises an attachment portion 110 configured to detachably attach the battery pack to the charger 100.

In a case of applying the present invention to an electric power tool, the present invention may be applied to an electric power tool provided with a brushed DC motor, or may be applied to an electric power tool configured to rectify an alternating-current voltage of a commercial power supply, or the like, to thereby drive a motor, or may be applied to an electric power tool configured to drive a universal motor with an alternating-current voltage.

The invention claimed is:

1. An apparatus for an electric power tool, comprising:

a controller configured to control an operation of the apparatus for an electric power tool in accordance with operating conditions that are previously set;

a storage device configured to previously store a settable item indicating an operating condition whose setting is changeable, among the operating conditions, and a settable range of the operating condition; and a communication device configured to perform communication with an external device, wherein the controller is configured to:

read the settable item and the settable range from the storage device in accordance with a request from the external device received by the communication device, and to transmit the settable item and the settable range to the external device through the communication device, determine, when a change request of the operating condition transmitted from the external device is received by the communication device, whether the change request corresponds to the settable item and the settable range stored in the storage device, change a setting of the operating condition in accordance with the change request if the change request corresponds to the settable item and the settable range, either prohibit change of the setting of the operating condition or correct the change request and then change the setting of the operating condition if the change request does not correspond to the settable item and the settable range, and set, if the change request corresponds to the settable item stored in the storage device and is outside the settable range stored in the storage device, the operating condition to one of an upper limit value and a lower limit value that is closest to the change request within the settable range in accordance with the change request.

2. The apparatus for an electric power tool according to claim 1, wherein the controller is configured to notify, if the change request does not correspond to at least one of the settable item or the settable range, the non-correspondence through a notification device.

3. The apparatus for an electric power tool according to claim 1, wherein the storage device stores, in addition to the settable item and the settable range, a settable step value that is a minimum unit when changing the setting of the operating condition, and wherein the controller is configured to also transmit the settable step value when transmitting the settable item and the settable range to the external device in accordance with the request from the external device.

4. The apparatus for an electric power tool according to claim 3, wherein the controller is configured such that, when a change request of the operating condition transmitted from the external device is received by the communication device and the setting of the operating condition is to be changed in accordance with the change request, and if a change value of the operating condition specified by the change request does not correspond to the settable step value, the controller corrects the change value to a change value that corresponds to the settable step value and then changes the setting of the operating condition.

5. The apparatus for an electric power tool according to claim 1, wherein the controller is configured to stop the operation of the apparatus for an electric power tool if a change request of the operating condition transmitted from the external device is received by the communication device while controlling the operation of the apparatus for an electric power tool.

6. The apparatus for an electric power tool according to claim 1, wherein the communication device is configured to perform a near field wireless communication with the external device.

7. The apparatus for an electric power tool according to claim 1, wherein the apparatus for an electric power tool is included in one of an electric power tool, a battery configured to be attached to the electric power tool, and a charger configured to charge the battery.

* * * * *